US011391530B2

(12) United States Patent
Tubb et al.

(10) Patent No.: US 11,391,530 B2
(45) Date of Patent: Jul. 19, 2022

(54) NON-CONTACT ELECTRO-MAGNETIC ACTUATOR AND METHOD

(71) Applicant: SUPERIOR SHOOTING SYSTEMS, INC., Canadian, TX (US)

(72) Inventors: George Wyatt Tubb, San Antonio, TX (US); G. David Tubb, Canadian, TX (US); Howard Kent, Waldport, OR (US)

( * ) Notice: Subject to any disclaimer, the term of this patent is extended or adjusted under 35 U.S.C. 154(b) by 0 days.

(21) Appl. No.: 16/856,327

(22) Filed: Apr. 23, 2020

(65) Prior Publication Data

US 2020/0386504 A1 Dec. 10, 2020

Related U.S. Application Data

(60) Provisional application No. 62/837,247, filed on Apr. 23, 2019.

(51) Int. Cl.

| | |
|---|---|
| ***F41A 19/17*** | (2006.01) |
| ***F41A 19/63*** | (2006.01) |
| ***F41A 17/56*** | (2006.01) |
| ***F41A 3/66*** | (2006.01) |
| ***F41A 19/59*** | (2006.01) |

(52) U.S. Cl.

CPC ..... *F41A 19/63* (2013.01); *F41A 3/66* (2013.01); *F41A 17/56* (2013.01); *F41A 19/59* (2013.01); *F41A 19/17* (2013.01)

(58) Field of Classification Search

None

See application file for complete search history.

(56) References Cited

U.S. PATENT DOCUMENTS

| | | | | |
|---|---|---|---|---|
| 8,109,024 | B2 * | 2/2012 | Abst | F41A 19/06 42/69.01 |
| 9,032,656 | B2 | 5/2015 | Lupher et al. | |
| 9,267,750 | B1 | 2/2016 | Tubb | |
| 9,557,129 | B2 | 1/2017 | Lupher | |
| 10,001,335 | B2 | 6/2018 | Patterson et al. | |
| 10,234,240 | B2 | 3/2019 | Northrup et al. | |

* cited by examiner

*Primary Examiner* — Reginald S Tillman, Jr.

(74) *Attorney, Agent, or Firm* — McKinney & Associates, LLC; J. Andrew McKinney, Jr.

(57) ABSTRACT

A rifle or portable firearm assembly (e.g., 310) configured to work with user-actuable sensors and systems (e.g., S1-S4), comprises a removable receiver assembly 312 attached to and responsive to a trigger assembly 50 which are removably received in a stock or chassis 316 having a middle section 324 with a trigger motion sensing sidewall segment with at least one trigger motion sensor (e.g., 340L, 340R) which does not physically contact or attach to the trigger assembly and is instead spaced from every component of the trigger assembly when the receiver is installed in said stock or chassis. The trigger motion sensor is configured to sense, from a selected standoff distance, without contacting or interfering the trigger assembly in any way, at least one of (a) the trigger's first stage movement or (b) actuation of a safety lever, and generate a "trigger motion sensed" signal in response thereto.

14 Claims, 8 Drawing Sheets

NON-CONTACT ELECTRO-MAGNETIC ACTUATOR AND METHOD

PRIORITY CLAIM AND CROSS-REFERENCE TO RELATED APPLICATIONS

This application is a continuation of and claims priority to U.S. provisional patent application no. 62/837,247, entitled "Non-Contact Electro-Magnetic Actuator and Method" which was filed on Apr. 23, 2019, the entire disclosure of which is incorporated herein by reference. The present application is also related to commonly owned application Ser. No. 14/462,348, filed Aug. 14, 2014, now U.S. Pat. No. 9,267,750, the entire disclosure of which is also incorporated herein by reference.

BACKGROUND

Field of the Invention

The present invention relates to firearms and more particularly to trigger mechanisms for use in rifles and other manually actuable instruments which carry or are configured with electro-optic sensors, target designators or other electronic accessories when in use by a shooter.

Discussion of the Prior Art

Rifle marksmanship has been continuously developing over the last few hundred years, and now refinements materials, manufacturing processes and portable sensors have made increasingly accurate aimed fire possible. These refinements have made previously ignored ergonomic or human factors more significant as sources of error.

The term "rifle" as used here, means a projectile controlling instrument or weapon (e.g., configured to aim and propel or shoot a projectile, and triggers or firearm actuator systems are discussed principally with reference to their use on rifles and embodied in mechanisms commonly known as trigger assemblies. Referring to FIGS. 1A-1C, a standard M40 rifle 10 (e.g., as further illustrated and described in USMC TM 05539-IN) has receiver assembly 12 with trigger assembly 20 carried within rifle stock 16 with trigger shoe 20S projecting downwardly through stock opening 22 as defined in stock channel 24 when receiver assembly 12 is installed in stock 16 and aligned therein so that barrel 14 is supported with the receiver's lug held in the stock's lug receiving recess 28. When assembled, rifle 10 provides easy access for the shooter or user to reach and manipulate trigger shoe 20S and the trigger assembly's safety lever 18.

It will become apparent, however, that trigger mechanisms for manually actuable instruments may include devices other than rifles, and may be used on instruments or weapons other than rifles which are capable of controlling and propelling projectiles (e.g., rail guns or cannon). The prior art provides a richly detailed library documenting the process of improving the ergonomics of actuating rifles and other firearms (e.g., as shown in FIGS. 1A-1E) and other manually actuable instruments.

Modern firearms such as rifles (e.g., 10, 40A or 40B) make use of optical and electro-optical accessories such as rifle scopes (e.g., S1 or S2, with electro-optic illuminated reticles (not shown)), coaxially aligned red-dot sights (e.g., S3) night vision sights (e.g., S4) or thermal sights (e.g., S4), and these typically each include controls (e.g., "off-on") to actuate control or power supply circuitry (not shown). When used in the field, these auxiliary or accessory systems (e.g., S1-S5) require the user or shooter to examine and manipulate the control buttons or switches of each device separately, sometimes in the dark.

Some creators of entirely new rifle systems have attempted to make the systems more user friendly and faster by incorporating electronic control circuits and sensors directly into a trigger assembly, which necessarily means that the user's and their armorers must now cope with a new, untested "hybrid" electromechanical trigger assembly which may, if the new electronics fail, render the firearm unusable in the field (or irreparable at the field level). For example, the system illustrated and described in TrackingPoint's U.S. Pat. No. 10,001,335 shows a trigger assembly which differs entirely from the tried-and true trigger assembly 20 used in standard M40 or M24 rifles, and these new hybrid trigger assemblies have been found wanting and rejected due to their unwelcome combination of fragility and strangeness (as viewed by the training and maintenance cadre).

Returning to FIGS. 1A-1E, the rifles (e.g., 10, 40A or 40B) are configured to fire ammunition cartridges that include a projectile seated in a casing. The casing has an internal cavity defined therein that contains a charge of rapidly combusting powder. A primer is seated in a recess formed in a rear portion of the casing. A hole in the primer casing places the primer in communication with the internal cavity containing the power. A projectile is seated in the front portion of the casing such that the powder is more or less sealingly contained in the casing between the primer and the projectile.

An action, such as a bolt action (e.g., as seen in FIGS. 1A and 1B), is used to fire the cartridge. For example, the action can include a striker that carriers a firing pin. The striker can be coupled to a biasing member, such as a spring. The spring provides a motive force for the striking to cause the firing pin to impact the primer. More specifically, the spring can be compressed, or cocked, by drawing the striker rearwardly. Engagement between a sear and the striker can maintain the striker in a cocked position.

The action can then be used to advance the cartridge into a firing chamber ahead of firing. While in the firing chamber, a trigger mechanism can be used to release the sear to cause the firing pin to strike the primer, causing the primer to ignite. The ignition is directed to the powder, which burns within the casing. The powder burns within the casing to generate a rapidly expanding gas, which propels the projectile out of the casing and through the barrel.

Safety mechanisms are often used in the trigger mechanism to selectively control whether the trigger mechanism may release the sear. However, safety mechanisms may interfere with trigger feel, trigger pull or other factors which directly and adversely affect the shooter's ability to precisely control trigger actuation.

When firing a shot, a trained shooter will carefully control breathing motions, check sight alignment as part of the continuous aiming process, and then carefully apply an initial pressure to the trigger, gradually increasing force to squeeze the trigger and "break" the shot at a moment which is chosen by the shooter to maximize the likelihood of a "hit" on the target. The shooter's ability to repeatably and precisely execute this planned sequence of steps is determined in part by the trigger assembly's ergonomics and consistent, repeatable operation. Bad triggers exhibit uneven response to trigger finger pressure (or "creep") and do not actuate or "break" cleanly and consistently. Often, a marksman or precision shooter will struggle to adjust the performance on a trigger to maximize that specific shooter's ability to precisely control trigger actuation or "break".

Traditional rifle triggers have been categorized as single stage triggers or two stage triggers (e.g., 20). Two-stage triggers are often used on military weapons. As the name implies, the trigger take-up is in two stages. The first stage is usually about ¼" of lighter "slack", before the second stage trigger pull begins, which ends with the trigger break. There is a difference in the weight of the trigger pull between the two stages which can be easily felt, where the first stage travel is light and the second stage requires notably greater force. A single-stage trigger does not typically have nearly as much travel as a two-stage trigger, so the shooter simply applies trigger pressure or force until the trigger breaks. Single stage triggers are more often used on sporting rifles.

Product liability lawsuits have exacerbated the shooter's ergonomics problems by forcing most manufacturers to design trigger assemblies which are nearly impossible for the shooter or user to tune or adjust. Some shooters will replace the entire trigger assembly in a rifle having a "lawyer's trigger" in the hopes of improving trigger adjustability. Shooters and those configuring Precision rifles (e.g., 10) with adjustable triggers often also want to be able to use sighting and other accessories in a manner which does not create new problems with reliability of the overall rifle system.

There is a need, therefore, for a rifle system having a robust and reliable trigger assembly which can be used to enhance the ergonomics of trigger actuation and allow the shooter or user to tune or customize the trigger for his or her needs while also aiding in the use of electro-optical and other accessories which may be mounted on or configured with the rifle system.

The subject matter claimed herein is not limited to embodiments that solve any of the cited disadvantages or that operate only in environments such as those described above. Rather, this background is only provided to illustrate one exemplary technology area where some examples described herein may be practiced.

SUMMARY OF THE INVENTION

Briefly, and in accordance with preferred embodiments, the present invention incorporates a rifle system having a robust and reliable trigger assembly which can be used to enhance the ergonomics of trigger actuation and allow the shooter or user to tune or customize the trigger for his or her needs while also aiding in the use of electro-optical and other accessories which may be mounted on or configured with the rifle system.

The rifle system of the present invention has a trigger motion sensor which is proximate a trigger assembly when the receiver assembly is installed in the stock (or chassis). The trigger motion sensor is configured to sense, from a selected standoff distance, without contacting or interfering the trigger assembly in any way, at least one of (a) said first stage movement or (b) actuation of said safety lever, and generate a "trigger motion sensed" signal in response thereto.

The rifle system of the present invention preferably includes a drop-in adjustable trigger assembly comprising a housing having a first side plate and a second side plate which carry a pivoting bolt sear which is connected to a sear safety linkage. The housing has a sear safety linkage slot defined therein which guides the pivoting sear safety linkage in response to actuation of an upwardly projecting thumb safety lever's actuation. A trigger bracket preferably carries a removable trigger shoe and is configured to pivot within the housing about a pivot point positioned within the housing's lower portion. This trigger bracket carries an adjustable rocker having (preferably) a first stage movement adjustment and a second stage length adjustment. The pivoting safety mechanism's safety linkage pivots rearwardly to push upon or cam a bolt sear upwardly, thus disengaging the bolt sear from the trigger sear.

The drop-in trigger assembly of the present invention is compact and robust, due in part to the configuration of the housing's parallel, planar left or first side plate and the second or right side plate which carry, orient and support the fixed and moving components of the assembly, including the pivoting safety lever which is rotatable about a transverse pin's axis from a forward "safety off" position to a rearward "safety on" position. The pivoting trigger bracket carries the adjustable transverse rocker member, which has an internal threaded bore that engages a rocker set screw to raise or lower the rocker, and the lower the rocker is positioned, the smaller the trigger's 1st stage take-up, because of an angled forward face on the pivoting trigger sear. As the transverse rocker moves down, the mechanical advantage is decreased, thus increasing the $2^{nd}$ stage weight of pull. The housing also carries a transverse trigger sear pin which defines the pivot axis for the trigger sear. The trigger sear has a forward face on the forward side of the pivot and has its trigger sear engagement surface on the rearward side of the pivot. The trigger assembly's sideplates preferably define unobstructed openings or non-ferrous segments proximate the trigger bracket, the sear's engagement face, the trigger shoe and the safety lever.

The rifle or portable firearm assembly of the present invention is configured to work with user-actuable sensors and systems and includes a removable receiver assembly including a receiver coaxially aligned with and attached to a barrel, where the receiver is attached to and responsive to the trigger assembly. The rifle system of the present invention has a stock or chassis having a middle section adapted to removably receive the receiver assembly its trigger assembly, and the stock or chassis middle section defines a lumen or cavity having a trigger motion sensing sidewall segment which is configured proximate the trigger assembly when the receiver is installed in the stock or chassis; where the stock or chassis is configured to receive and support the user-actuable sensors and systems (e.g., any of S1-S4). The trigger motion sensing sidewall segment includes a trigger motion sensor which does not physically contact or attach to the trigger assembly and is instead spaced from every component of the trigger assembly by a selected "clearance" distance (e.g., at least 0.5 mm) when the receiver is installed in said stock or chassis.

In the rifle system of the present invention, the trigger assembly comprises a housing incorporating first and second spaced wall plates, a trigger bracket pivotally mounted between the wall plates which is configured to pivot within the housing about a pivot point positioned within the housing and a trigger shoe carried by said trigger bracket which is configured to disengage a firing mechanism in response to a force applied by the shooter or user. The trigger assembly also includes a safety mechanism actuable by a safety lever mounted on the housing where the trigger assembly is configured to provide a first stage movement in response to a first force applied by a user and, if the user applies a second force greater than said first force, a second stage movement.

Since the trigger assembly sideplates define openings or non-ferrous segments proximate at least one of the trigger bracket, trigger shoe and safety lever, those trigger assembly sideplate openings or non-ferrous segments are aligned with at least one of the trigger bracket, said trigger shoe and said safety lever to define a transverse trigger motion sensing axis. The transverse trigger motion sensing axis is aligned to intersect the stock middle section's trigger motion sensor which is proximate said trigger assembly when said receiver is installed in said stock or chassis. The trigger motion sensor is configured to sense, from a selected standoff distance, without contacting or interfering the trigger assembly in any way, at least one of (a) first stage movement or (b) actuation of the safety lever, and generate a "trigger motion sensed" signal in response thereto for transmission to auxiliary accessories (e.g., such as one or more of scopes or sights S1-S4).

In an exemplary embodiment, the trigger bracket, trigger shoe and safety lever are all made from steel or another magnetic flux focusing material, and the transverse trigger motion sensing axis substantially intersects a Hall effect trigger motion sensor which does not physically contact or attach to the trigger assembly and is instead spaced from every component of said trigger assembly by a selected "clearance" distance (e.g., at least 0.5 mm) when the receiver is assembled or installed in the stock or chassis.

Alternatively, the rifle or portable firearm assembly can include a trigger bracket, trigger shoe and said safety lever which are made from steel or another substantially opaque material, and the transverse trigger motion sensing axis substantially intersects an optical sensor which does not physically contact or attach to the trigger assembly and is instead spaced from every component of the trigger assembly by a selected distance (e.g., at least 0.5 mm) when the receiver is installed in the stock or chassis.

The rifle or portable firearm assembly may be a standard (e.g., Remington 700 style, M40 or M24) receiver, attached to and responsive to the trigger assembly of the present invention where the trigger motion sensor is configured to sense at least one of (a) first stage movement, (b) second stage movement or (c) actuation of the safety lever and generate a trigger motion sensed signal for the user-actuable sensors and systems (e.g., S1-S4) in response. The rifle or portable firearm assembly of the present invention preferably has a stock or chassis with a bore axis extending along a longitudinal axis comprising a forward section adapted to receive a portion of the barrel where the middle section is aligned with the forward section and adapted to receive the receiver carrying the trigger assembly, where the stock or chassis middle section cavity trigger motion sensing sidewall segment is configured beside and proximate the trigger assembly when the receiver is installed in the stock or chassis. In the exemplary embodiment, the stock or chassis is configured with power and communication connections to provide power and communication between the trigger motion sensing sidewall segment and the user-actuable sensors and systems (e.g., S1-S4).

The above and still further features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF PREFERRED EMBODIMENTS

Figure 1A:
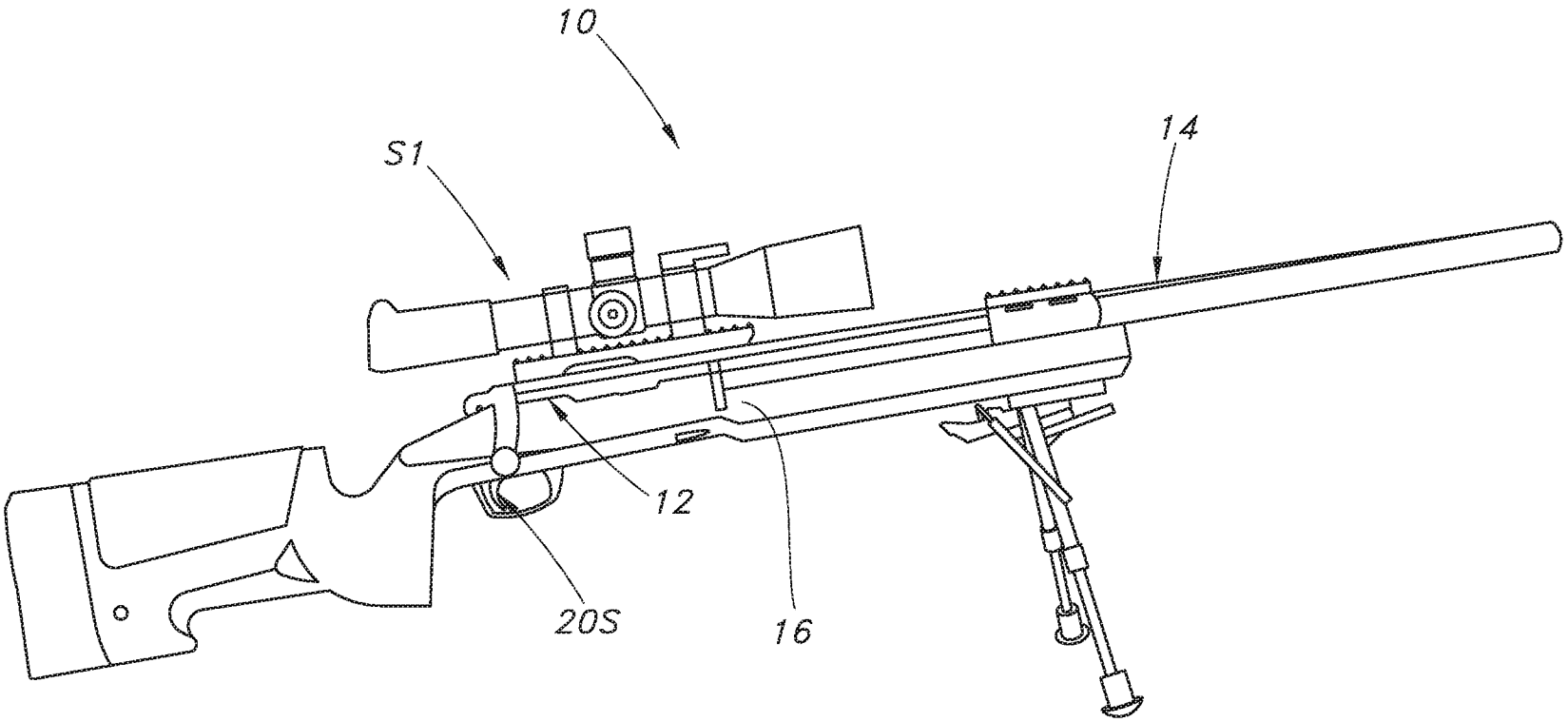
FIGS. 1A, 1B and 1C illustrate a prior art firearm of the type (e.g., a USMC M40) which incorporates a standardized trigger assembly well understood by shooters and armorers.
Figure 1B:
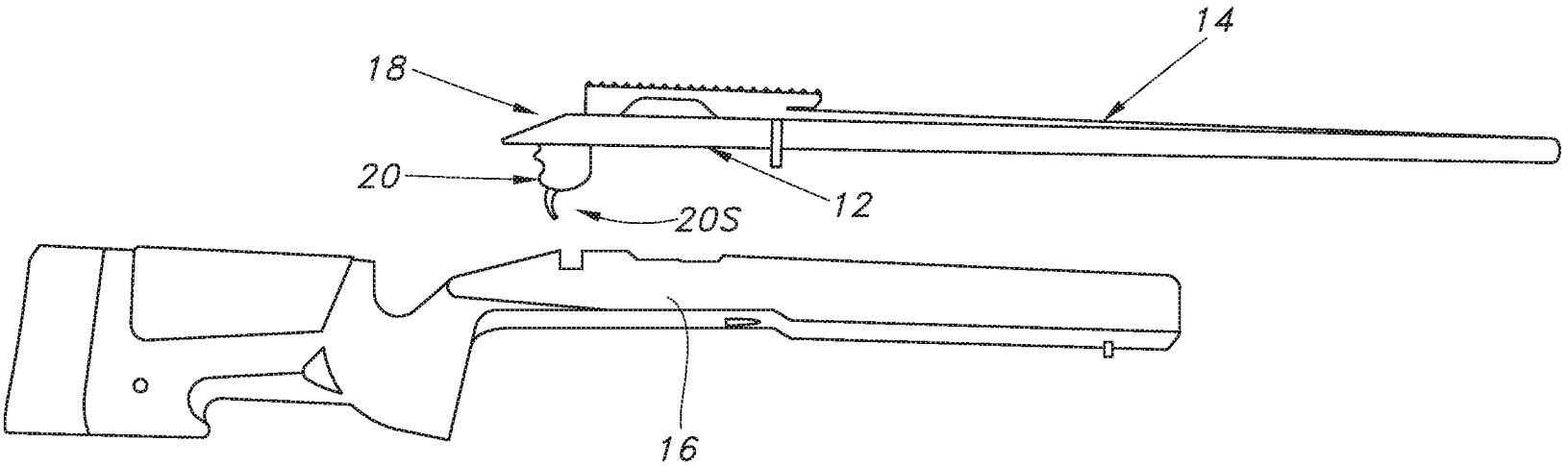
Figure 1C:
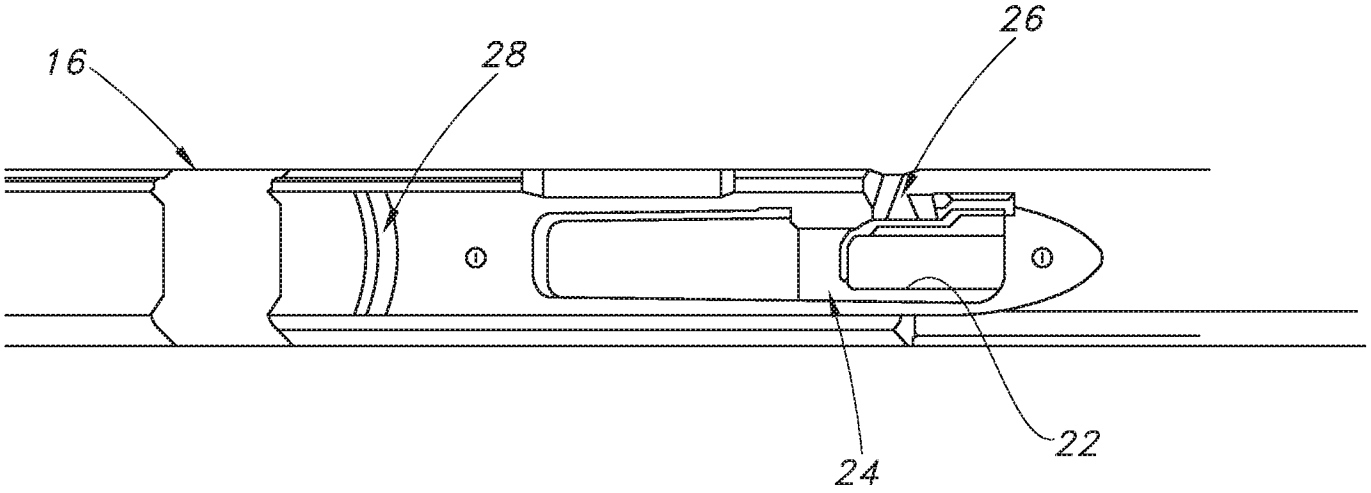
Figure 1D:
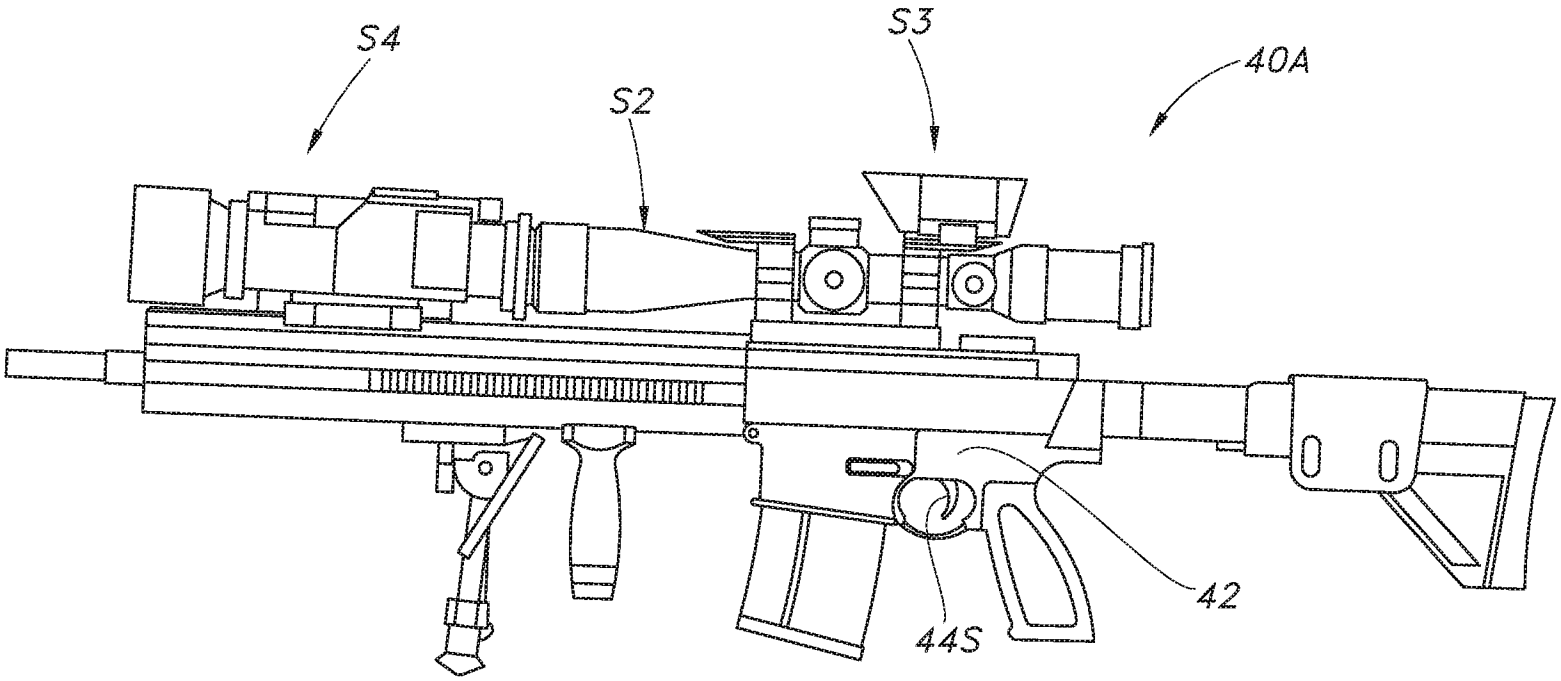
FIGS. 1D and 1E illustrate another prior art firearm of the type (e.g., a US M110 SASS) which incorporates another form of standard trigger assembly well understood by shooters and armorers.
Figure 1E:
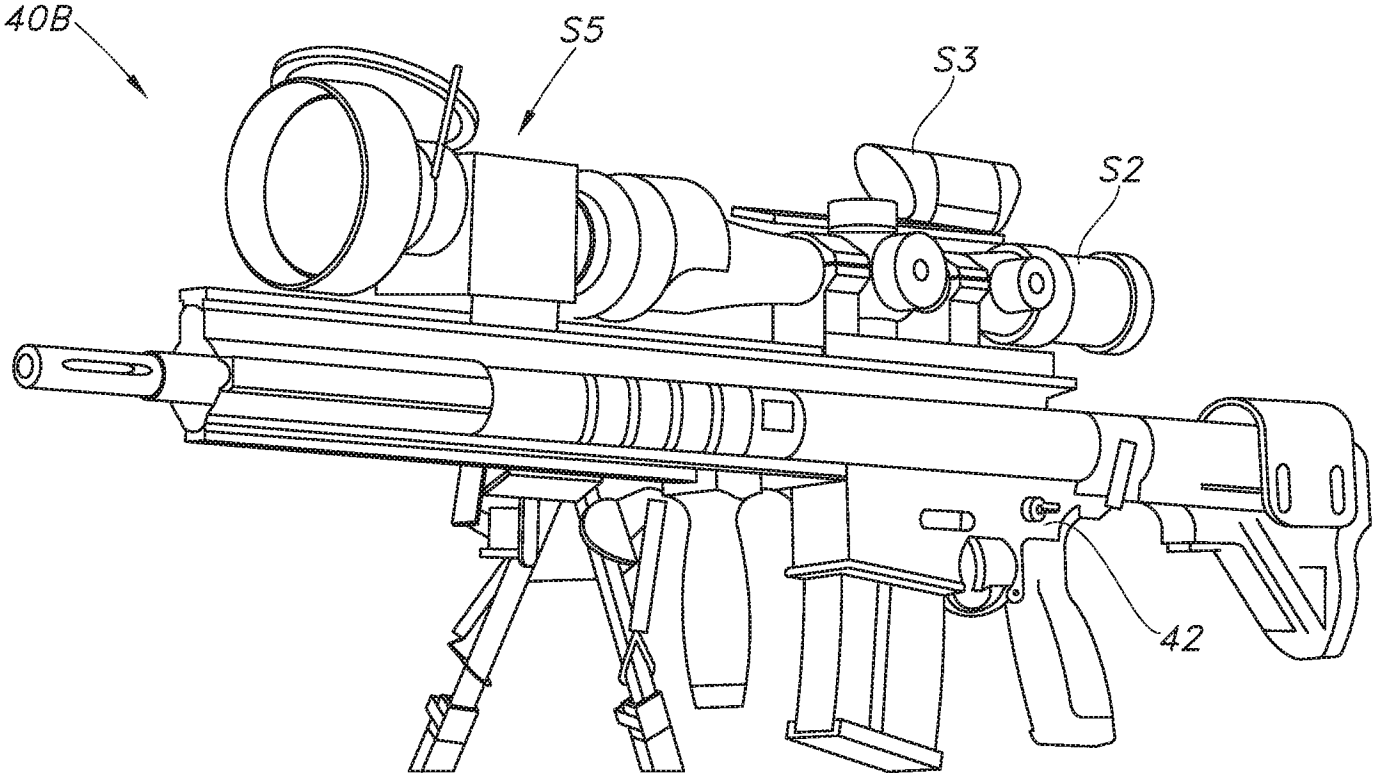
Figure 4:
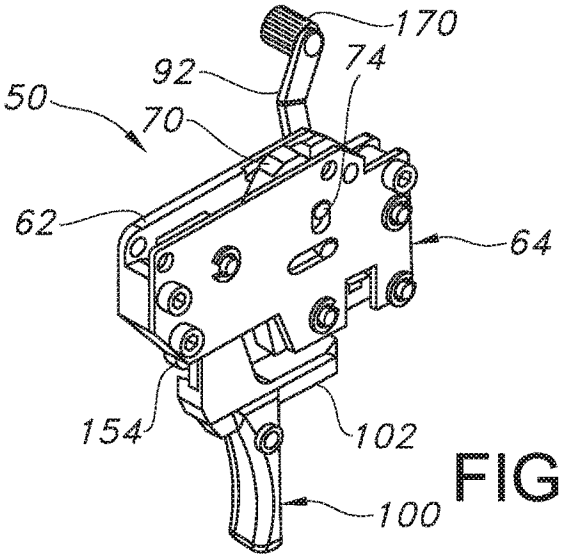
FIGS. 2-5 illustrate exemplary embodiments of the rifle or portable firearm system trigger assembly configured to work with user-actuation detection sensors and systems in accordance with the method of the present invention.
Figure 5:
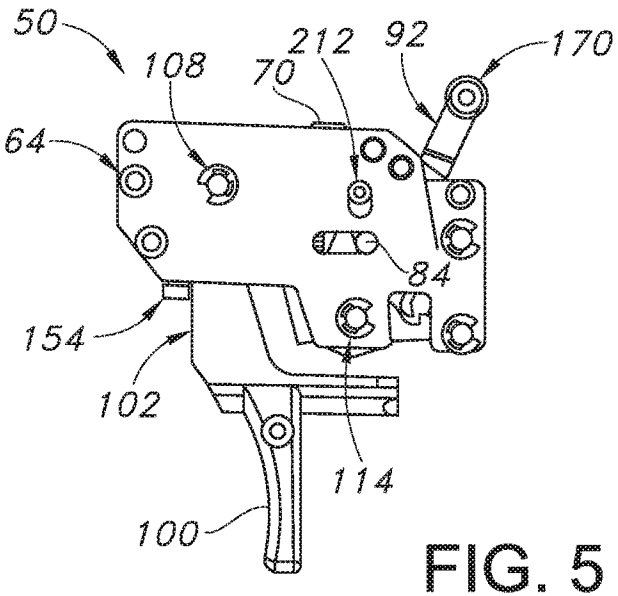

Turning now to a more detailed description of the present invention, FIGS. 1A-1C illustrate a standard prior art rifle 10 in which the standard trigger assembly 20 and the standard stock 16 may be modified to provide the advantages of the system and method of the present invention.

In accordance with the method and structure of the present invention, rifle system 310 has a robust and reliable trigger assembly 50 which can be used to enhance the ergonomics of trigger actuation and allow the shooter or user to tune or customize the trigger for his or her needs while also aiding in the use of electro-optical and other accessories (e.g., S1-S4) which may be mounted on or configured with the rifle system 310.

Figure 6:
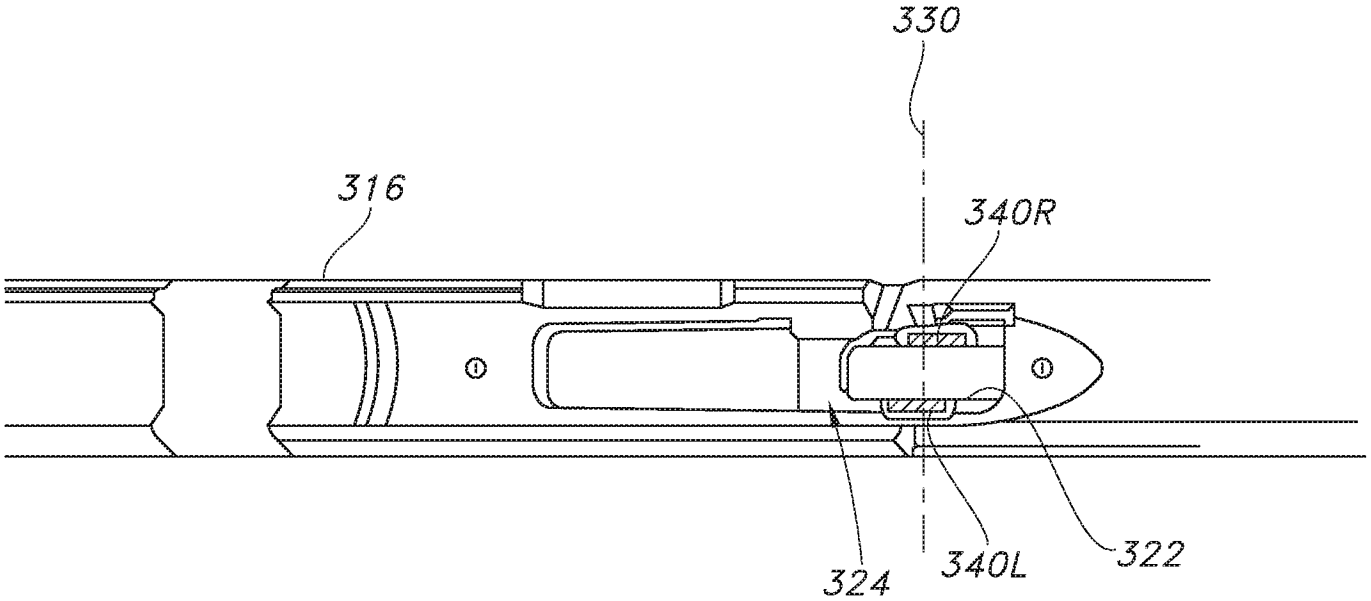
FIG. 6 illustrates an exemplary embodiment of the rifle or portable firearm system configured to provide with a user-actuable trigger motion sensor system in accordance with the present invention.
Figure 7:
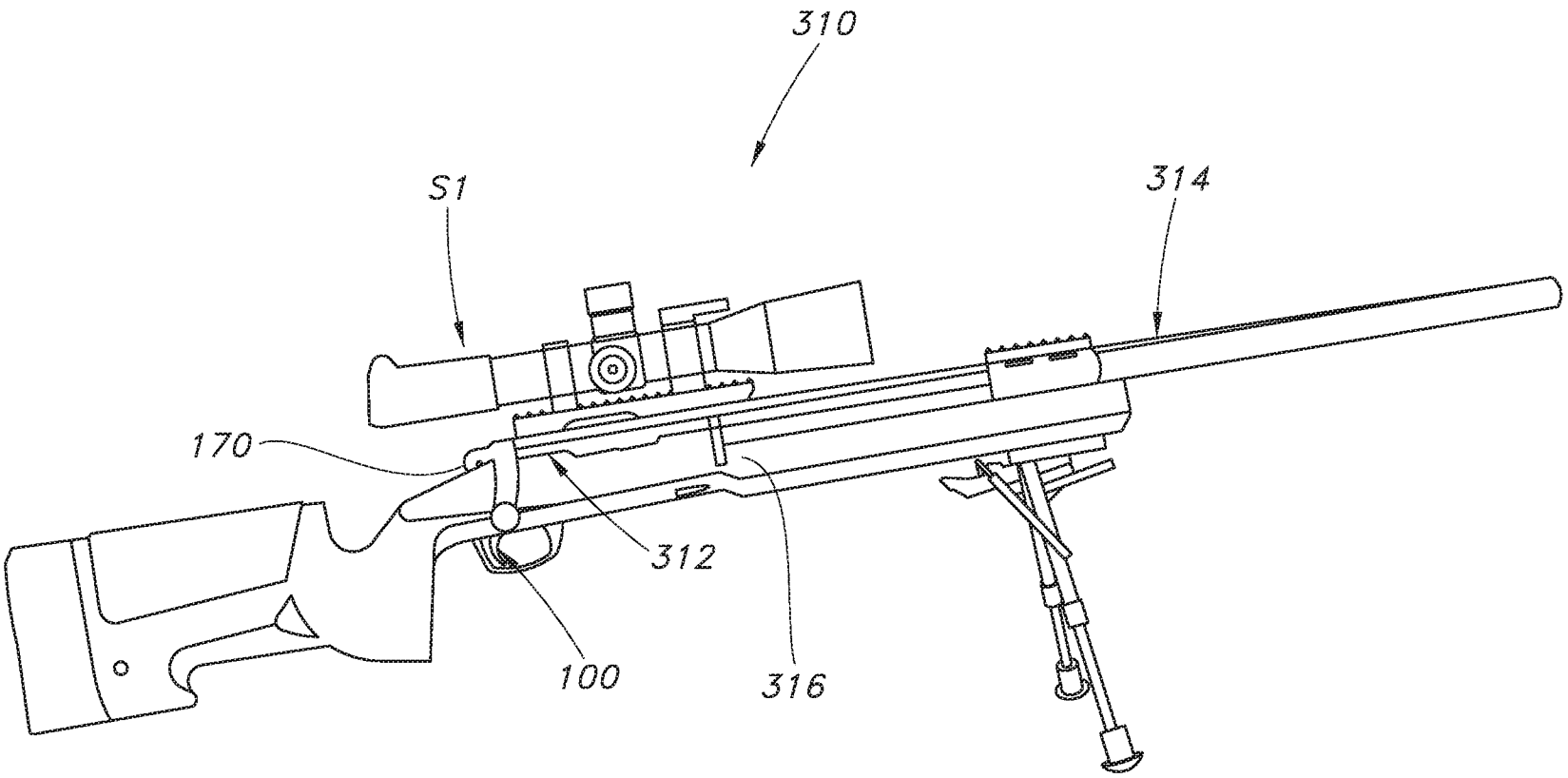
FIG. 7 illustrates an exemplary embodiment of the rifle or portable firearm system configured to work with user-actuable sensor and system components of FIGS. 2-6, in accordance with the method of the present invention.

Rifle system 310 has at least one trigger motion sensor (e.g., 340L, 340R) which is proximate trigger assembly 50 when the receiver assembly 312 is installed in the stock (or chassis) 316. Referring to the exemplary embodiment of FIG. 6, Stock 316 has an open trough or channel 324 which is bounded by opposing sidewalls in which are mounted sensor segments (e.g., 340L, 340R) separated by the width of the open trough 324, and each aligned to intersect a transverse motion sensing or sensor axis 330. The trigger motion sensor (e.g., 340L, 340R) is configured to sense (from a selected standoff distance, without contacting or interfering with the trigger assembly 50 in any way) at least one of (a) first stage movement or (b) actuation of safety lever 170, and generate a "trigger motion sensed" signal in response.

The rifle system 310 and method of the present invention preferably includes installing a drop-in adjustable trigger assembly 50 comprising a housing having a first side plate and a second side plate which carry a pivoting bolt sear which is connected to a sear safety linkage. The housing has a sear safety linkage slot defined therein which guides the pivoting sear safety linkage in response to actuation of an upwardly projecting thumb safety lever's actuation. A trigger bracket 102 preferably carries a removable trigger shoe 100 and is configured to pivot within the housing about a pivot point positioned within the housing's lower portion. This trigger bracket preferably carries an adjustable rocker 130 having a first stage movement adjustment and a second stage length adjustment. The pivoting safety mechanism's safety linkage pivots rearwardly to push upon or cam a bolt sear upwardly, thus disengaging the bolt sear from the trigger sear.

Trigger assembly 50 is compact and robust, due in part to the configuration of the housing's parallel, planar left or first side plate and the second or right side plate which carry, orient and support the fixed and moving components of the assembly, including the pivoting safety lever which is rotatable about a transverse pin's axis from a forward "safety off" position to a rearward "safety on" position. The pivoting trigger bracket carries the adjustable transverse rocker member, which has an internal threaded bore that engages a rocker set screw to raise or lower the rocker, and the lower the rocker is positioned, the smaller the trigger's 1st stage take-up, because of an angled forward face on the pivoting trigger sear. As the transverse rocker moves down, the mechanical advantage is decreased, thus increasing the 2nd stage weight of pull. The housing also carries a transverse trigger sear pin which defines the pivot axis for the trigger sear. The trigger sear has a forward face on the forward side of the pivot and has its trigger sear engagement surface on the rearward side of the pivot. The trigger assembly's sideplates preferably define unobstructed openings or non-ferrous segments proximate the trigger bracket, the sear's engagement face, the trigger shoe and the safety lever.

The rifle or portable firearm assembly 310 is configured to work with user-actuable sensors and systems (e.g., S1-S4) and includes a removable receiver assembly 312 including a receiver coaxially aligned with and attached to a barrel 314, where the receiver is attached to and responsive to the trigger assembly 50. Rifle system 310 has a stock or chassis having a middle section 324 defining a trough or channel adapted to removably receive the receiver assembly 170 and its trigger assembly 50, and the stock or chassis middle section defines a lumen or cavity having a trigger motion sensing sidewall segment along the transverse motion sensing or sensor axis 330 which is configured proximate the trigger assembly 50 when the receiver is installed in the stock or chassis; where the stock or chassis is configured to receive and support the user-actuable sensors and systems (e.g., any of S1-S4). The trigger motion sensing sidewall segment includes one or more trigger motion sensors (e.g., 340L and 3409R) which are carried within the opposing sidewall segments on opposing sides separate from trigger assembly 50 and so do not physically contact or attach to the removable drop-in trigger assembly 50 as illustrated in FIGS. 2-6, where no part of the trigger motion sensors (e.g., 340L and 3409R) are illustrated as being part of trigger assembly 50. So every part of the trigger motion sensor system (e.g., 340L and 3409R) is spaced from every component of the trigger assembly by a selected "clearance" distance (e.g., at least 0.5 mm) when the receiver 170 carrying trigger assembly 50 is installed in the stock or chassis.

In rifle system 310, trigger assembly 50 comprises a housing incorporating first and second spaced wall plates, a trigger bracket pivotally mounted between the wall plates which is configured to pivot within the housing about a pivot point positioned within the housing and a trigger shoe carried by said trigger bracket which is configured to disengage a firing mechanism in response to a force applied by the shooter or user. The trigger assembly also includes a safety mechanism actuable by a safety lever mounted on the housing where the trigger assembly is configured to provide a first stage movement in response to a first force applied by a user and, if the user applies a second force greater than said first force, a second stage movement.

Since the trigger assembly sideplates define openings or non-ferrous segments proximate at least one of the trigger bracket, trigger shoe and safety lever, those trigger assembly sideplate openings or non-ferrous segments are aligned with at least one of the trigger bracket, said trigger shoe and said safety lever to define a transverse trigger motion sensing axis. The transverse trigger motion sensing axis is aligned to intersect the stock middle section's trigger motion sensor which is proximate said trigger assembly when said receiver is installed in said stock or chassis. The trigger motion sensor is configured to sense, from a selected standoff distance, without contacting or interfering the trigger assembly in any way, at least one of (a) first stage movement or (b) actuation of the safety lever, and generate a "trigger motion sensed" signal in response thereto for transmission to auxiliary accessories (e.g., such as one or more of scopes or sights S1-S4).

In the exemplary embodiment illustrated in FIGS. 2-7, at least one of the trigger bracket 102, trigger shoe 100 and safety lever 170 are made from steel or another magnetic flux focusing material, and the transverse trigger motion sensing axis 330 substantially intersects a Hall effect trigger motion sensor (e.g., 340L, 340R) which does not physically contact or attach to the trigger assembly 50 and is instead spaced from every component of trigger assembly 50 by a selected "clearance" or trigger-to-sensor distance (e.g., at least 0.5 mm) when the receiver 170 is assembled or installed in the stock or chassis 316.

Alternatively, the rifle or portable firearm assembly can include a trigger bracket, trigger shoe and said safety lever which are made from steel or another substantially opaque material, and the transverse trigger motion sensing axis 330 substantially intersects an optical sensor (e.g., positioned at 340L, 340R) which does not physically contact or attach to the trigger assembly and is instead spaced from every component of the trigger assembly by a selected trigger-to-sensor distance (e.g., at least 0.5 mm) when the receiver is installed in the stock or chassis.

Rifle or portable firearm assembly 310 include be a standard (e.g., Remington 700 style, M40 or M24) receiver, attached to and responsive trigger assembly 50 where the trigger motion sensor (e.g., 340L, 340R) is configured to sense at least one of (a) first stage movement, (b) second stage movement or (c) actuation of the safety lever and generate a trigger motion sensed signal for the user-actuable sensors and systems (e.g., S1-S4) in response. The rifle or portable firearm assembly of the present invention preferably has a stock or chassis with a bore axis extending along a longitudinal axis comprising a forward section adapted to receive a portion of the barrel (e.g., 314) where the middle section is aligned with the forward section and adapted to receive the receiver when carrying trigger assembly 50, where the stock or chassis middle section cavity trigger motion sensing sidewall segment is configured beside and proximate the trigger assembly when the receiver is installed in the stock or chassis. In the exemplary embodiment, the stock or chassis is configured with power and communication connections to provide power and communication between the trigger motion sensing sidewall segment's sensors (e.g., 340L, 340R) and the user-actuable sensors and systems (e.g., S1-S4).

In an alternative embodiment, an M110 style rifle (e.g., 40A or 40B) is re-configured with a lower receiver including a standard trigger where the lower receiver 42 is altered to include at least one receive trigger motion sensor (e.g., 340L, 340R) which senses trigger component motion without touching or interfering with the trigger assembly's mechanical components, in accordance with the method of the present invention.

Figure 2:
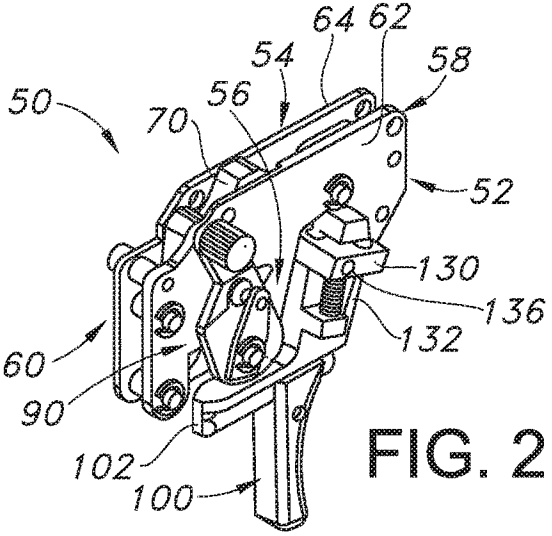
Figure 3:
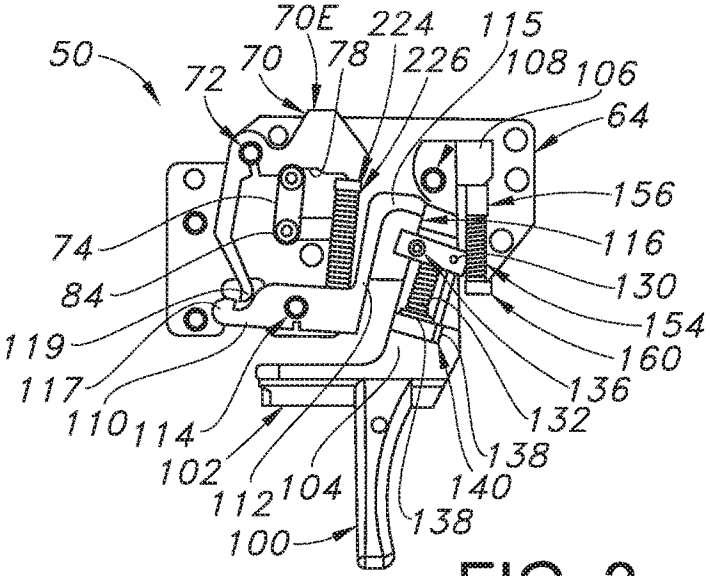

Turning next to FIGS. 2-5, trigger mechanism 50 may be utilized the place of a prior art trigger assembly 20 for use in actuating a firing pin or striker mechanism as is found in a typical bolt assembly found in a standard rifle such as a Remington 700® brand bolt action rifle or M40 rifle 10. Trigger assembly 50 of the present invention is generally illustrated FIGS. 2-5, to which reference is now made. As illustrated, the drop-in trigger assembly 50 has a housing 52 enclosing the assembly and having an upper portion 54, a lower portion 56, a forward portion 58, and a rearward portion 60, with the housing being formed by a first, or right-side wall plate 62 and a second or left-side wall plate 64. As best seen in FIG. 3, wherein plate 62 is removed, and in FIG. 6, the housing 52 carries a pivoting bolt sear member 70 mounted on a bolt sear pin 72 extending between plates 62 and 64. A pivoting sear safety linkage 74 is mounted between plates 62 and 64 and has an upper camming surface which engages a lower surface 78 of the pivoting bolt sear member 70. The housing has opposed sear safety linkage slots 80 and 82 in plates 62 and 64, respectively, which receive a lower pin 84 of linkage 74 to guide the pivoting sear safety linkage 74 in response to actuation of an upwardly projecting thumb safety linkage 90 actuated by a thumb safety lever 92.

As illustrated, the trigger assembly 50 preferably includes a removable trigger shoe 100 beneath the housing which engages the bottom leg of a generally L-shaped trigger bar or bracket 102 which has an upwardly extending leg portion 104 pivotally mounted to a short pivot pin 108 which extends between and is supported by the housing plates 62 and 64 so that the trigger bracket 102 is configured to pivot within the housing 52 about the transverse axis of pivot pin 108 when trigger shoe 100 is pressed or squeezed by the shooter. An L-shaped trigger sear 110 having an upwardly and forwardly extending neck portion 112 is pivotally mounted on a safety pin 114 which extends through corresponding opposed apertures in housing plates 62 and 64 and is secured by suitable E-clips. The forwardmost end 115 of the trigger sear 110 is angled, or v-shaped, and engages an oval point set screw 116 threaded into an aperture 116' on the rear surface of the upper end 104 of the trigger bracket 102. The rearwardmost end 117 of the L-shaped trigger sear 110 incorporates a latching trough or edge 118 which receives and engages the lowermost end 119 of the pivoting bolt sear member 70.

The upper portion 104 of the trigger bracket 102 carries on its right-hand surface a first rocker screw support 120 spaced from a second, lower rocker screw support 122 and the trigger bracket's spaced rocker screw supports 120 and 122 extend laterally through an opening in the housing plate 62 when the housing is assembled. The pair of spaced rocker screw supports 120 and 122 receive an adjustable transverse rocker 130 positioned according to the user's desire at a selected distance from the upper rocker support 120 by a rocker screw 132 which passes through a threaded internal bore 134 in rocker 130 and is secured by a set screw 136, with a disc spring 138 at the bottom of the screw securing the screw in the bracket and urging the screw upwardly. An L-shaped rocker spring 140 engages the rocker at its upper end. The rocker preferably has a first stage movement adjustment and a second stage length adjustment. The rocker screw 132 and set screw 136 are adjustable to raise or lower the rocker to provide first stage trigger movement adjustment; the lower the rocker 130 is positioned, the smaller the trigger's 1st stage take-up, because of the angled forward face 112 on the pivoting trigger sear 110. Furthermore, as the transverse rocker 130 moves down, the mechanical advantage of the trigger mechanism is decreased, thus increasing the $2^{nd}$ stage weight required to fire, or increasing the force needed to cause the trigger to actuate or "break" (also known as the "weight of pull").

The trigger bar or bracket 102 has a forward end which provides a trigger bracket distally projection member 106 (FIGS. 3 and 6), and at the limit of the actuated movement of trigger bar or bracket 102, trigger bracket distally projection member 106 bears upon or rests on a plunger 156 and an adjustable spring 154 captured in an upper shoulder portion 150 of a support element 152 which is a part of, or is secured to, the wall plate 62 and spans the distance between right plate 62 and the opposing left wall plate 64. A spring 154 and a pin 156 extend through an aperture 158 of support element 152 and are adjustably secured therein by screw 160, with the top of the pin abutting the lower surface of trigger stop 106, to bias the trigger bar or bracket 102 in the unfired or rest position.

The pivoting safety mechanism 90, as best seen in FIG. 2, includes a thumb safety linkage or lever 92 incorporating at its upper or distal end a knurled cylinder 170 secured by a screw 172 and at its lower or proximal end a connector plate 174 which pivotally mounts the lever 92 to the housing plate 62 by way of a safety lever pivot pin 176. Safety pivot pin 176 passes through aperture 178 in connector plate 174 and apertures 180 and 182 in housing plates 62 and 64, respectively, and is secured at opposite ends by E clips and 184 and 186. A ball-detent safety tab 190 is mounted on pin 176 and is secured against the outer surface of the connector plate 174, with a bottom flange 194 of the tab engaging a bottom edge 196 of the plate 174 so that the tab 190 rotates with the plate 174. The tab provides a spring bias which bears against and secures a ball bearing 200 in an aperture 202 in safety connector plate 174, the ball bearing extending through the aperture to serve as a detent that engages one or the other of spaced apart side plate apertures 204 or 206 to provide a positive "feel" as the safety mechanism 90 pivots between "on" or "off" positions.

The connector plate 174 also incorporates a safety linkage aperture 210 which is aligned with slot 80 in housing plate 62 and receives the lower pin 84 of pivoting sear safety linkage 74, so that pivoting the thumb safety linkage lever 92 between on and off positions causes pin 84 to move back and forth in side plate slot 80 (and in its opposing slot 82 in housing plate 64). This motion causes the upper pin 212 of pivoting sear safety linkage 74 to move vertically in its corresponding vertical side plate slots 214 and 216 in housing plates 62 and 64, respectively.

Mounted between an upper surface 220 of the L-shaped trigger sear 110 and a downwardly facing surface 222 of pivoting bolt sear member 70 is a spring-biased reset pin 224 surrounded by a spring 226. The lower end of reset pin 224 is tapered and received in a depression 230 in upper surface 220 of the L-shaped trigger sear 110. The reset pin spring 226 causes the L-shaped trigger sear 110 to reset after the trigger mechanism has been operated to fire a shot.

The components of trigger assembly 50 are preferably manufactured from steel, aluminum, or a similarly durable material, using wire EDM machining methods, laser cutting, CNC machining, forming presses or casting methods. The trigger mechanism 50 works by closing the bolt on a rifle or similar firearm which transfers firing pin spring force from the bolt assembly through a cocking piece's firing pin engagement surface which then bears upon to the upper engagement surface at the top of pivoting bolt sear member 70, which projects from the top portion of housing 50, as illustrated in FIGS. 2-5. With the trigger assembly of the present invention 50 installed in a firearm such as rifle 310 it will not fire until the cocking piece forces the bolt sear's upper engagement surface down and pivots the bolt sear 70 in a clockwise direction, as viewed in FIG. 3, sufficiently far to cause the distal tip 119 of bolt sear 70 to engage the latch 118 on the engagement surface of trigger sear 110 (best seen in FIG. 3). The pivoting motion terminates when the upper end 76 of the sear safety linkage 74 presses against and engages bolt sear 70 at bolt sear lower bearing surface 78, thus preventing the bolt sear from pivoting further under force from the bolt sear reset spring 226 and disengaging the bolt sear's distal tip 119 from the trigger sear's engagement surface 118. The bolt sear 70 is thus configured to work with and actuate cocking piece 32 in a rifle's bolt assembly (e.g., as used in rifle 10 or 310).

Drop-in trigger assembly 50 is compact and robust, due in part to the configuration of the housing's right side plate 62 and left side plate 64, which carry, orient and support the fixed and moving components of the assembly. Although not described, it will be evident from the exploded view of FIG. 6 that numerous screws and pins extend between the side plates to secure the movable parts within or on the housing. These components include the pivoting safety linkage 90 and its thumb safety lever 92 which is rotatable about the axis of transverse pivot pin 176 from a forward "safety off" position to a rearward "safety on" position. Pivoting sear safety linkage 74 is driven by sear safety linkage pin 84, which is transversely inserted in the safety lever connector plate aperture 210 which drives the lower end of the elongated pivoting sear safety linkage 74 forwardly or rearwardly in elongated housing slots 80 and 82 to cause the sear safety linkage's upper end 76 to be moved downwardly or upwardly, respectively, in slots 214 and 216 in response to safety linkage movement.

As described above, the internal threaded bore 134 of the pivoting transverse rocker 130 engages rocker screw 132 to raise or lower the rocker, and the lower the rocker is positioned, the smaller the trigger's 1st stage take-up distance, because rocker 130 then bears against the angled forward face 112 on the pivoting trigger sear 110. The housing also carries the transverse trigger sear pivot pin or safety pin 114 which defines the pivot axis for the L-shaped trigger sear 110 and trigger sear 110 has its forward face 112 on the forward side of the pivot. Trigger sear 110 has its trigger sear engagement surface 118 on the rearward side of the pivot pin 114 (FIG. 3).

In use, when the shooter moves the pivoting safety lever 92 from the rearward "safety on" position to the forward "safety off" position (FIG. 19), the pivoting safety link's sear safety linkage pin 84 is shifted to its forward position in slots 80 and 82, and the pivoting safety link's upper pin 212 is pulled down in its corresponding slots 214 and 216. This disengages pivoting safety link 74 from the bolt sear's lower bearing surface 78, thus allowing the bolt sear 70 to pivot counter-clockwise, under force from the bolt assembly's firing pin spring, when the rifle is fired. Bolt sear reset spring 226 will "reset" the bolt sear's distal tip 119 into engagement with the trigger sear's engagement surface 118 when the rifle's bolt is cycled.

When the shooter moves the pivoting safety lever from the forward "safety off" position to the rearward "safety on" position, the safety linkage pin 84 drives the lower end of pivoting safety link 74 rearwardly in the housing slots 80 and 82 so that the sear safety linkage's upper pin 212 pivots upwardly in slots 214 and 216, pressing pivoting safety link's upper surface 76 against and engaging the lower bearing surface 78 of the bolt sear 70. This prevents the bolt sear from pivoting under force from the cocked bolt assembly's firing pin spring (not shown) and disengages the bolt sear's distal tip 119 from the engagement surface 118 of the trigger sear 110. In accordance with the present invention, when the user touches the trigger 100 or the safety lever 170, a signal is generated to actuate the user's sighting or other systems with sensors (e.g., optical sights S1-S4).

As noted above, trigger assembly 50 incorporates user adjustable controls for a first stage weight of pull, first stage travel or movement range, second stage break weight and second stage engagement length, each of which can be optimized separately for accurate shooting. In the illustrated embodiment of FIGS. 2-5, the trigger mechanism uses two springs, where first stage weight is adjusted by compressing spring 154 with adjustment screw 160, which preferably has a spring constant of approximately 15.8 lbs per inch. Trigger reset spring 226 serves to reset the connection between the bolt sear and the trigger sear for firing the next shot and reset spring 226 is constrained and guided by reset pin 224 which engages bolt sear 70 on the pin's (upper) while end trigger sear 110 bears on reset spring 226 at the spring's lower end. Reset spring 226 preferably has a spring constant of approximately 29 lbs per inch.

It will be appreciated by persons of skill in the art that the trigger assembly 50, when installed in a rifle (e.g., 310), is actuated when trigger shoe 100 is pressed, which pivots trigger bracket 102 rearward about pivot pin 108 (clockwise in FIG. 3), causing the trigger bar or bracket 102 to force rocker 130 rearwardly toward the forward surface 112 of trigger sear 110. In response, trigger sear 110 pivots slightly (counterclockwise in FIG. 3), reducing the $2^{nd}$ stage engagement overlap between edges 118 and 119 to just a few thousandths of an inch (e.g., 0.002-0.005 in). At some point during this rearward travel, trigger bracket 102 stops pivoting rearwardly because rocker 130 has engaged the trigger sear 110, thus ending the length of the $1^{st}$ stage of trigger pull. As the shooter or marksman continues to increase trigger pressure on trigger shoe 100, the rocker 130 begins rotating the trigger sear 110, until the last few thousandths of an inch of overlapping engagement length of its latching edge 118 is free of engagement with surface 119 of the bolt sear 70, thus breaking contact and enabling trigger actuation in that instant. In response to this release, the bolt sear 70 pivots forward and down (clockwise in FIG. 3), releasing cocking piece 32 in bolt assembly 30 to drive the firing pin (not shown) into the cartridge, firing the rifle. The first stage weight for trigger assembly 50 is adjustable by the control or set screw 116 independently of the first stage length of travel, which is controlled by the rocker vertical position adjustment screw 132. The second stage weight is adjusted, in part, by the rocker adjustment screw 132 on the trigger bracket's side which moves rocker 130 up and down, changing its mechanical advantage. The second stage length of engagement is adjusted by the control screw or adjustment set screw 116 which is threaded into a bore 116' inside the upper end 104 of the trigger bracket 102 that defines the distal surface to push on the very upper end of the front surface 115 of trigger sear 110, pivoting it away from the bolt sear to set the "crisp" break (or actuation sensation) of trigger assembly 50. The second stage weight is also adjusted by the spring 154 and its adjustment screw 160, which oppose the rotation of the trigger bracket 102. Trigger assembly 50 thus has adjustable first stage length of pull, first stage weight, second stage length of pull and second stage weight. The total weight is the sum of first stage weight and second stage weight and is adjustable from 8 ounces to three and one half pounds. Using these adjustments, the trigger first stage weight and second stage weight can be adjusted by the user for to achieve, for example, a total weight of 30 ounces where either the first stage weight is 5 ounces (meaning the second stage weight is a relatively heavy 25 ounces) or where the first stage weight is 25 ounces (meaning the second stage weight is a relatively light 5 ounces).

The safety mechanism consists of thumb safety linkage 90 which cams pivoting safety link 74 past top dead center, pushing upward on the bolt sear 70 and locking it in place, while simultaneously disengaging from the trigger sear 110. The ball detent mechanism (190, 200 and apertures 204 and 206) captures the safety linkage 90 and keeps it in place, providing an audible and tactile "click" sensation of positive control for the shooter. The pivoting safety link or sear safety linkage 74 and thumb safety linkage 90 comprise a "two-bar linkage" which cooperate to provide large mechanical advantage but require small safety actuating force from the user, and an "overcamming" action provided by the travel of sear safety linkage 74 in the slots of housing plates 62 and 64 serves as a failsafe adapted to prevent accidental release of the bolt assembly's firing pin and discharge. When the safety is on the sear safety linkage 74 engages the bottom surface 78 of bolt sear 102, pivoting it up (clockwise in FIG. 6) to disengage it from the trigger sear 110 and preventing it from rotating to fire the firearm. The illustrated trigger assembly 50 is adaptable for use with a left hand side safety lever which projects downwardly into the area proximate the trigger shoe.

Persons of skill in the art will appreciate that the system and method of the present invention makes available a Non-Contact Electro-Magnetic Actuator system configured for use in a firearm assembly (e.g., 310) configured to work with user-actuable systems with sensors (e.g., optical sights S1-S4), where a non-contacting sensor can be used to enable, energize or actuate the red dot, illuminated reticle, ranging reticle or system or other accessories incorporated in the attached systems with sensors (e.g., optical sights S1-S4). Once the trigger assembly or component motion is detected, an "energize" or "actuate" signal is generated (e.g., in response to sensing motion of the trigger 100 or safety lever 170) and that actuation signal may be transmitted wirelessly (e.g., by Bluetooth) or by a wired connection (not shown) to the systems with sensors (e.g., optical sights S1-S4). The system of the present invention (in the exemplary illustrated embodiment comprises a receiver assembly 312 attached to and responsive to a trigger assembly 50 is configured with a stock or chassis 316 having a middle section 324 that defines a lumen or cavity having a trigger motion sensing sidewall segment which is configured proximate said trigger assembly, wherein said stock or chassis is configured to receive, support and operate with the user-actuable systems with sensors (e.g., optical sights S1-S4). Preferably the trigger motion sensing sidewall segment includes a trigger motion sensor (e.g., 340L, 340R) which does not physically contact or attach to said trigger assembly and is instead spaced from every component of said trigger assembly by a selected trigger-to-sensor distance when said receiver is installed in said stock or chassis.

Having described preferred embodiments of a new and improved trigger assembly structure and method, it is believed that other modifications, variations and changes will be suggested to those skilled in the art in view of the teachings set forth herein. It is therefore to be understood that all such variations, modifications and changes are believed to fall within the true spirit and scope of the present invention as defined by the following claims.

What is claimed is:

1. A rifle or portable firearm assembly configured to work with user-actuable sensors and systems, comprising:

a removable receiver assembly including a receiver coaxially aligned with and attached to a barrel, said receiver also being attached to and responsive to a trigger assembly;

a stock or chassis having a middle section adapted to removably receive said receiver assembly with said trigger assembly; wherein said stock or chassis middle section defines a lumen or cavity having a trigger motion sensing sidewall segment which is configured proximate said trigger assembly when said receiver is installed in said stock or chassis;

said stock or chassis being configured to receive and support the user-actuable sensors and systems;

wherein said trigger motion sensing sidewall segment includes a trigger motion sensor which does not physically contact or attach to said trigger assembly and is instead spaced from every component of said trigger assembly by a selected trigger-to-sensor distance when said receiver is installed in said stock or chassis; wherein said trigger assembly comprises a housing incorporating first and second spaced wall plates, a trigger bracket carrying a trigger shoe which is configured to disengage a firing mechanism in response to a force applied by a user; said trigger assembly also including a safety mechanism actuable by a safety lever mounted on said housing; said trigger assembly being configured to provide a first stage movement in response to a first force applied by a user and, if the user applies a second force greater than said first force, a second stage movement; wherein said trigger assembly side plates define openings or non-ferrous segments proximate at least one of said trigger bracket, said trigger shoe and said safety lever, and wherein said trigger assembly side plate openings or non-ferrous segments are aligned with at least one of said trigger bracket, said trigger shoe and said safety lever to define a transverse trigger motion sensing axis; wherein said transverse trigger motion sensing axis is aligned to intersect said stock or chassis middle section's trigger motion sensor which is proximate said trigger assembly when said receiver is installed in said stock or chassis;

wherein said trigger motion sensor is configured to sense, from a selected standoff distance, without contacting or interfering the trigger assembly in any way, at least one of (a) said first stage movement or (b) actuation of said safety lever, and generate a "trigger motion sensed" signal in response thereto.

2. The rifle or portable firearm assembly of claim 1, wherein at least one of said trigger bracket, said trigger shoe and said safety lever are made from steel or another magnetic flux focusing material, and wherein said transverse trigger motion sensing axis substantially intersects a Hall effect trigger motion sensor which does not physically contact or attach to said trigger assembly and is instead spaced from every component of said trigger assembly by a distance of at least 0.5 mm when said receiver is installed in said stock or chassis.

3. The rifle or portable firearm assembly of claim 1, wherein at least one of said trigger bracket, said trigger shoe and said safety lever are made from steel or another substantially opaque material, and wherein said transverse trigger motion sensing axis substantially intersects an optical sensor which does not physically contact or attach to said trigger assembly and is instead spaced from every component of said trigger assembly by a distance of at least 0.5 mm when said receiver is installed in said stock or chassis.

4. The rifle or portable firearm assembly of claim 1, wherein said receiver comprises a standard receiver, said standard receiver being attached to and responsive to said trigger assembly;

wherein said trigger motion sensor is configured to sense at least one of said first stage movement, said second stage movement or actuation of said safety lever and generate a trigger motion sensed signal for the user-actuable sensors and systems in response thereto.

5. The rifle or portable firearm assembly of claim 1, wherein said stock or chassis has a bore axis extending along a longitudinal axis comprising a forward section adapted to receive a portion of said barrel; said middle section being aligned with said forward section and adapted to receive said receiver with said trigger assembly; wherein said stock or chassis middle section cavity trigger motion sensing sidewall segment is configured beside and proximate said trigger assembly when said receiver is installed in said stock or chassis; said stock or chassis being configured with power and communication connections to provide power and communication between said trigger motion sensing sidewall segment and said user-actuable sensors and systems;

wherein said trigger motion sensor is configured to sense at least one of said first stage movement or actuation of said safety lever and generate a trigger motion sensed signal which is communicated from said trigger motion sensing sidewall segment to said user-actuable sensors and systems as an actuation signal for the user-actuable sensors and systems in response thereto.

6. The rifle or portable firearm assembly of claim 5, wherein at least one of said trigger bracket, said trigger shoe and said safety lever are made from steel or another magnetic flux focusing material, and wherein said transverse trigger motion sensing axis substantially intersects a Hall effect trigger motion sensor which does not physically contact or attach to said trigger assembly and is instead spaced from every component of said trigger assembly by a selected trigger-to-sensor distance of at least 0.5 mm when said receiver is installed in said stock or chassis.

7. The rifle or portable firearm assembly of claim 6, wherein said a receiver comprises a standard bolt action receiver coaxially aligned with and attached to said barrel, said standard bolt action receiver being attached to and responsive to said trigger assembly;

wherein said trigger motion sensor is configured to sense at least one of said first stage movement, said second stage movement or actuation of said safety lever and generate a trigger motion sensed signal for the user-actuable sensors and systems in response thereto.

8. The rifle or portable firearm assembly of claim 5, wherein said trigger assembly has a housing incorporating first and second spaced wall plates;

a trigger bracket pivotally mounted between said wall plates and configured to pivot within the housing about a pivot point positioned within the housing;

a removable trigger shoe carried by said trigger bracket;

an adjustable rocker mounted on said trigger bracket;

a bolt sear pivotally mounted between said wall plates and having a first latching end and a spaced second end;

a trigger sear pivotally mounted between said wall plates and having a first end engaging said rocker on said rocker and a second end engageable with said bolt sear latching end;

a reset spring extending between and engaging said bolt sear and said trigger sear;

a safety mechanism actuable by a thumb safety lever mounted on said housing and incorporating a pivotable sear safety linkage mounted between said housing wall plates and movable in corresponding safety linkage slots defined in the wall plates to guide the pivoting sear safety linkage to engage said bolt sear in response to actuation of said thumb safety lever;

a first stage movement adjustment for said rocker; and a second stage length adjustment for said trigger sear.

9. The rifle or portable firearm assembly of claim 8, wherein said pivotable sear safety linkage incorporates an upper camming surface which, upon actuation, pivots the bolt sear to disengage the bolt sear latching end from the trigger sear.

10. The rifle or portable firearm assembly of claim 9, wherein said first stage movement adjustment for said rocker comprises a rocker adjustment screw mounted in said trigger bracket to move the rocker up and down to change its mechanical advantage when bearing against the trigger sear.

11. A Non-Contact Electro-Magnetic Actuator configured for use in a firearm assembly configured to work with user-actuable systems with sensors, comprising:

a receiver assembly attached to and responsive to a trigger assembly is configured with a stock or chassis having a middle section that defines a lumen or cavity having a trigger motion sensing sidewall segment which is configured proximate said trigger assembly, wherein said stock or chassis is configured to receive, support and operate with the user-actuable systems with sensors;

wherein said trigger motion sensing sidewall segment includes a trigger motion sensor which does not physically contact or attach to said trigger assembly and is instead spaced from every component of said trigger assembly by a selected trigger-to-sensor distance when said receiver carrying said trigger assembly is installed in said stock or chassis; wherein said trigger assembly comprises a trigger assembly housing which supports a safety mechanism actuable by a safety lever;

said trigger assembly being configured to provide movement in response to a force applied by a user;

wherein said trigger assembly housing comprises first and second spaced wall plates, and further comprises a trigger bracket pivotally mounted between said first and second spaced wall plates and configured to pivot within the housing about a pivot point positioned within the housing and a trigger shoe carried by said trigger bracket which is configured to disengage a firing mechanism in response to said force applied by said user; said trigger assembly being configured to provide a first stage movement in response to a first force applied by a user and, if the user applies a second force greater than said first force, a second stage movement.

12. A Non-Contact Electro-Magnetic Actuator configured for use in a firearm assembly configured to work with user-actuable systems with sensors, comprising:

a receiver assembly attached to and responsive to a trigger assembly is configured with a stock or chassis having a middle section that defines a lumen or cavity having a trigger motion sensing sidewall segment which is configured proximate said trigger assembly, wherein said stock or chassis is configured to receive, support and operate with the user-actuable systems with sensors;

wherein said trigger motion sensing sidewall segment includes a trigger motion sensor which does not physically contact or attach to said trigger assembly and is instead spaced from every component of said trigger assembly by a selected trigger-to-sensor distance when said receiver carrying said trigger assembly is installed in said stock or chassis;

and wherein said trigger assembly comprises a trigger assembly housing which supports a safety mechanism actuable by a safety lever; said trigger assembly being configured to provide movement in response to a force applied by a user;

wherein said wherein said trigger assembly defines a transverse trigger motion sensing axis;

wherein said transverse trigger motion sensing axis is aligned to intersect said trigger motion sensor which is proximate to but not part of or in contact with said trigger assembly;

wherein said trigger motion sensor is configured to sense, without contacting or interfering with the trigger assembly in any way, at least one of (a) said first stage movement or (b) actuation of said safety lever, and generate a "trigger motion sensed" signal in response thereto.

13. The Non-Contact Electro-Magnetic Actuator of claim 12, wherein at least one of said trigger bracket, said trigger shoe and said safety lever are made from steel or another magnetic flux focusing material, and wherein said transverse trigger motion sensing axis substantially intersects a Hall effect trigger motion sensor which does not physically contact or attach to said trigger assembly and is instead spaced from every component of said trigger assembly by said trigger-to-sensor distance which is at least 0.5 mm when said receiver is installed in said stock or chassis.

14. The Non-Contact Electro-Magnetic Actuator of claim 13, wherein at least one of said trigger bracket, said trigger shoe and said safety lever are made from steel or another substantially opaque material, and wherein said transverse trigger motion sensing axis substantially intersects an optical sensor which does not physically contact or attach to said trigger assembly and is instead spaced from every component of said trigger assembly by said selected trigger-to-sensor distance of at least 0.5 mm when said receiver is installed in said stock or chassis.

* * * * *